United States Patent [19]

Robles

[11] Patent Number: 5,010,666

[45] Date of Patent: Apr. 30, 1991

[54] CUSHIONED FRAMED ARTICLE

[75] Inventor: Carlos Robles, Lomas Vista Hermosa, Mexico

[73] Assignee: Plasticos Cream, S.A., Mexico

[21] Appl. No.: 51,540

[22] Filed: May 18, 1987

[30] Foreign Application Priority Data

May 26, 1986 [MX] Mexico ..... 2599

[51] Int. Cl.[5] ..... A47G 1/06; G09F 1/12

[52] U.S. Cl. ..... 40/154; 40/616

[58] Field of Search ..... 40/154, 616; 5/434, 5/442, 490, 491

[56] References Cited

U.S. PATENT DOCUMENTS

| | | | |
|---|---|---|---|
| 236,244 | 1/1881 | Nurre | 40/158.1 |
| 561,480 | 6/1896 | Booth | 40/158.1 |
| 944,910 | 12/1909 | Reilley | 5/490 |
| 3,283,345 | 11/1966 | Berck | 5/490 X |
| 3,956,838 | 5/1976 | Gerrish | 40/154 |
| 4,091,481 | 5/1978 | Redman | 40/434 |
| 4,170,836 | 10/1979 | Seufert | 40/158.1 |
| 4,309,784 | 1/1982 | Cohen | 5/490 |
| 4,393,612 | 7/1983 | Clark | 40/158.1 |

*Primary Examiner*—Kenneth J. Dorner
*Assistant Examiner*—J. Hakomaki
*Attorney, Agent, or Firm*—Boniard I. Brown

[57] ABSTRACT

The invention provides a cushioned frame for a picture or other article, which has a bottom layer with edges, a relatively rigid base with first and second sides, a layer of foam material secured to the base by adhesive stripes and having the configuration the size of the base, an upper layer of material sealed along its edge portions to edges of the bottom layer to enclose the foam layer, a transparent or translucent layer over the upper layer and adapted to fit in the section defined by the adhesive stripes, this layer being secured to the upper layer by depressed heat-seal stripes and cooperating therewith to define an envelope for a generally planar article, the foam layer being compressed at the stripes which bond the transparent or translucent layer, the upper layer and the foam material layer.

The apparatus includes an adhesive applicator machine having a vat, a supporting frame slidable on guide rails above the vat, to receive bases, articulated arms for moving an adhesive printing assembly into the vat and into engagement with the bases, and an actuator for the arms. A locating device for accurate positioning of layers, a dielectric sealing device, and a die-cutting apparatus, are utilized.

5 Claims, 4 Drawing Sheets

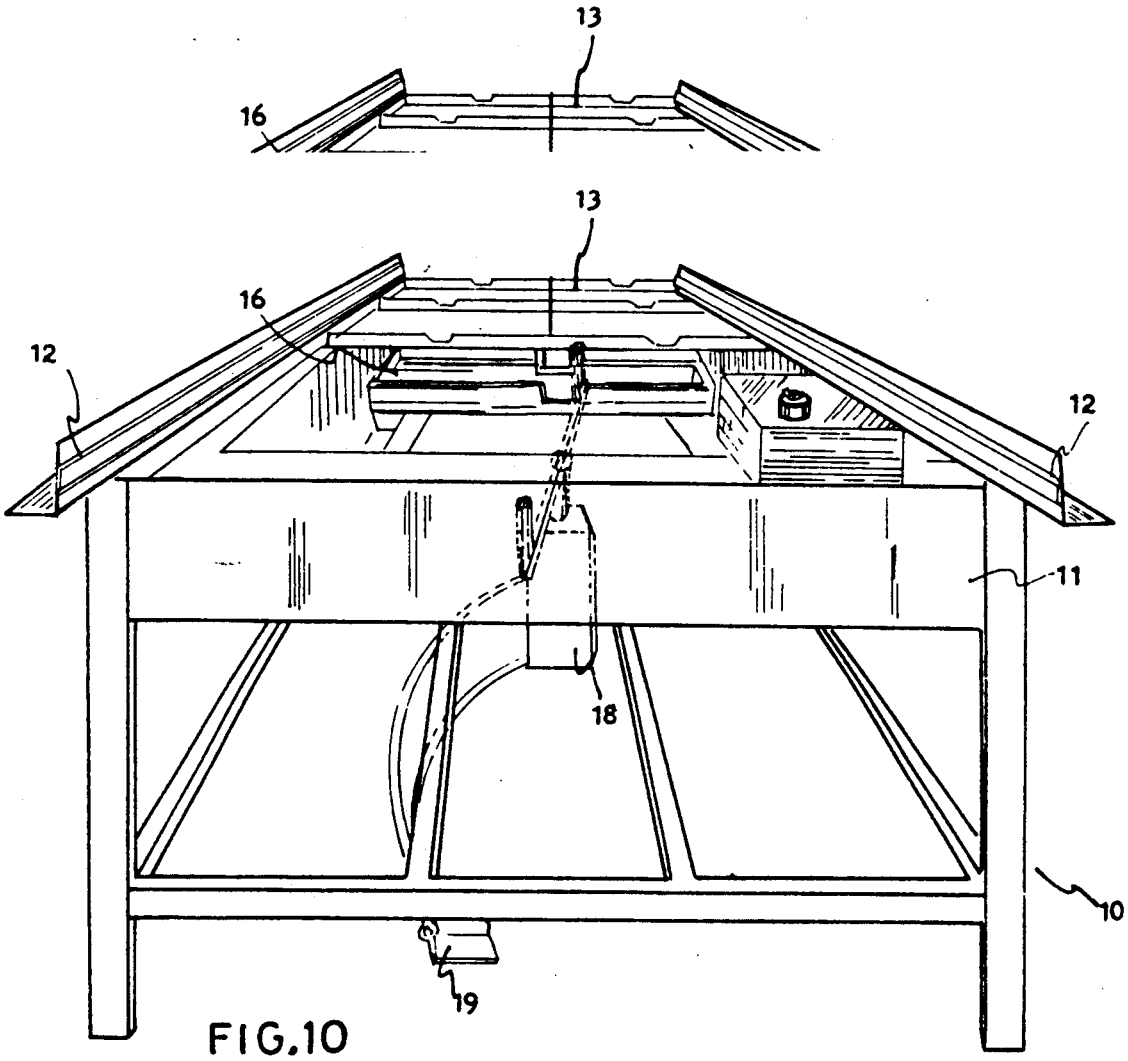
FIG.10
FIG. 11
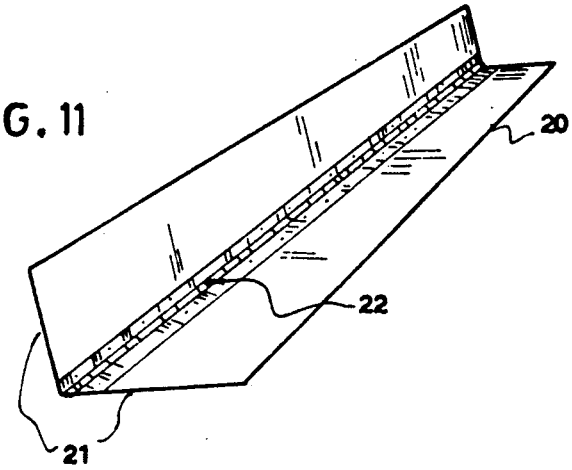

CUSHIONED FRAMED ARTICLE

BACKGROUND OF THE INVENTION

Nowadays we found in the market a diverse variety of articles made of plastic materials, among them we shall refer to those which esentially consist of a solid or rigid base or support covered by a plastic layer, a fabric layer or the like. Usually these articles are sold in the form of notebooks, photo albums, picture frames, etc.

Heretofore and since this kind of articles were firstly elaborated they have been changing in order to satisfy the needs of the consumers regarding aspect and utility. In the beginning these fancy articles were made of printed cardboard or cardboard covered or enveloped with printed paper; then the cardboard began to be covered with a fabric layer instead of paper and later a layer of plastic material was used so as to achieve more durability, for instance a printed plastic vinyl material. In the case of covering with fabric the texture of the obtained product was not so acceptable since the fabric upon bonding to the support by means of an adhesive acquires a hard texture. An alternative method for avoiding this hard texture was sewing the fabric about the base or support in order to not use adhesive; however this sewing operation makes difficult a commercial production.

Many combinations of materials have been created so as to achieve a better appearance and utility of the articles, however these combinations stay limited to their bonding process which has to be applicable under commercial volumes.

One of the combinations which up to date has been successful, mainly because of its smooth finishing texture, is the one which includes a foam material between the layers of the outer materials, whereby the obtained article is cushioned in either one or both sides.

These cushioned articles are manufactered by providing: a bottom layer of heat-sealable material, a base material which confers rigidity to the article, a foam material and an upper layer of heat-sealable material; this arrangement is thermetically sealed at the edges of the upper and bottom layers of heat-sealable material, thereby enveloping the rigid base and the foam material and providing an article with a smooth cushioned finishing.

OBJECT OF THE INVENTION

The object of the present invention is an article which has an enhanced quality than that of the known cushioned articles; also the object of the invention is a process and a system for manufacturing said improved article.

The article of the invention is characterized in that besides being cushioned, it has on the cushioned surface a section or plurality of sections in bas-relief which modify the flat aspect of the article to an irregular aspect originated by internal seals or lines of heat-sealing, this means seals inside or over the cushioned surface (not only seals at the edges of the article).

Said internal seals offer the possibility of making the flat article to adopt the characteristics of a frame of an irregular or regular shape by means of the depression of the delinations of the frame whereby the framed surface is in high-relief giving volume to the same; and the delinations of the frame stay in bas-relief.

On the other hand not only the article per se is novel, but the process and the system for manufacturing it are also novel.

The process of the invention takes advantage of the heat-sealable characteristics of the materials and takes into consideration that the base or support is not of a heat-sealable material. For that reason, either on one or both surfaces of the base as desired, is provided a stripe or section of adhesive which stripe is coincident with the delineation of the frame; said delinations will be the zones in bas-relief and consequently the internal sealing zones.

The system of the invention esentially consists of: a gumming device for applying adhesive on the base or support; a guiding device for locating the materials in their exact site where they will be sealed; a dielectric sealer for sealing the materials both in their sealing sites and later at the edges of the article; a die cutting device for triming the remaining material once the edges have been sealed.

BRIEF DESCRIPTION OF THE DRAWINGS

The following drawings refer to a modality of the invention:

FIG. 10, is another view of the gumming machine, during operation; and

FIG. 11, is a perspective view of the locating device of the present invention.

DETAILED DESCRIPTION OF THE PREFERRED EMBODIMENTS

Figure 1:
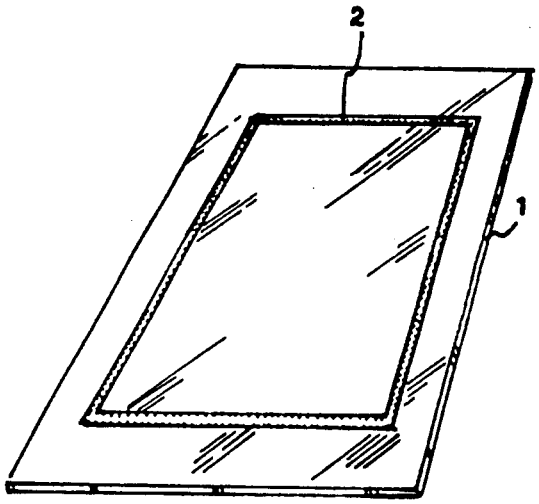
FIG. 1, is a perspective view of a base provided with adhesive sections, for manufacturing the framed cushioned article of the invention.
Figure 2:
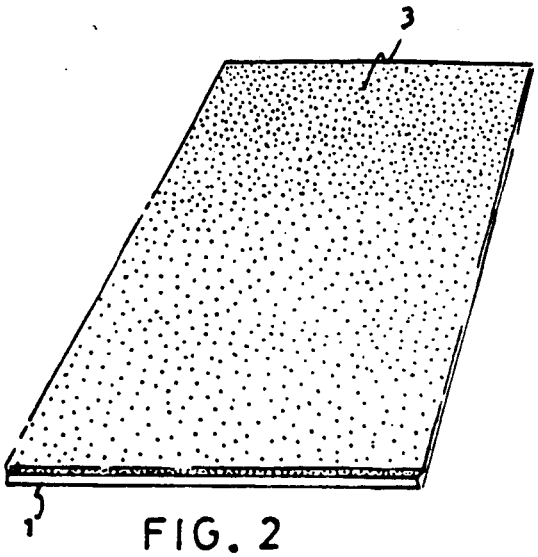
FIG. 2, is a similar view of FIG. 1 but including a layer of foamy material.
Figure 3:
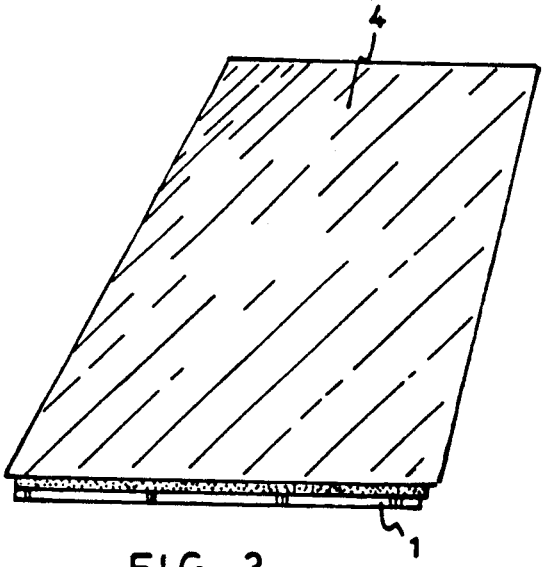
FIG. 3, is a similar view of FIG. 2 but including an upper layer of heat-sealable material.
Figure 4:
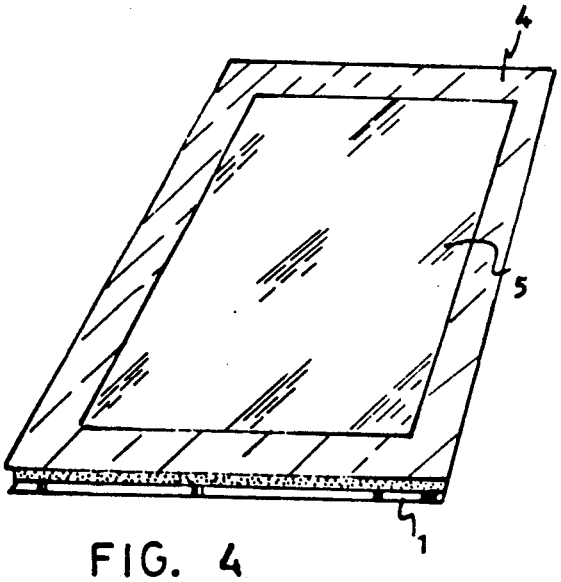
FIG. 4, is a similar view of FIG. 3 but including a section of a transparent heat-sealable material.
Figure 5:
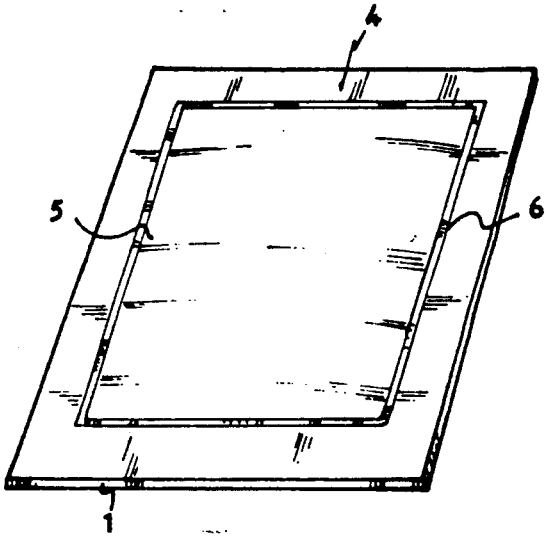
FIG. 5, is a similar view of FIG. 4 but already sealed in the zones corresponding to the adhesive sections or stripes.
Figure 6:
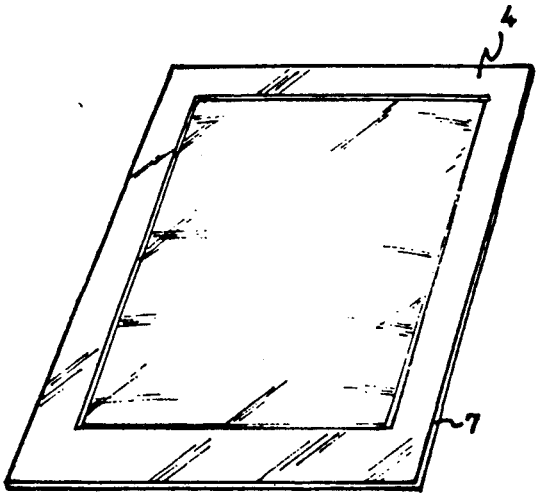
FIG. 6, is a similar view of FIG. 5 including a bottom layer of heat-sealable material.
Figure 7:
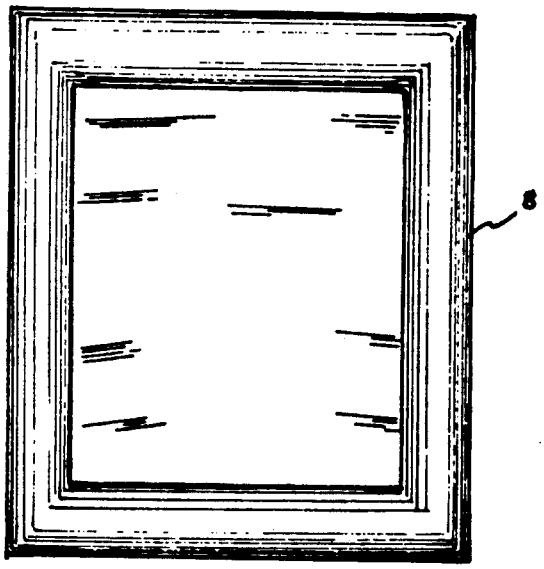
FIG. 7, is a frontal view of the cushioned article with its edges already sealed and trimmed.
Figure 8:
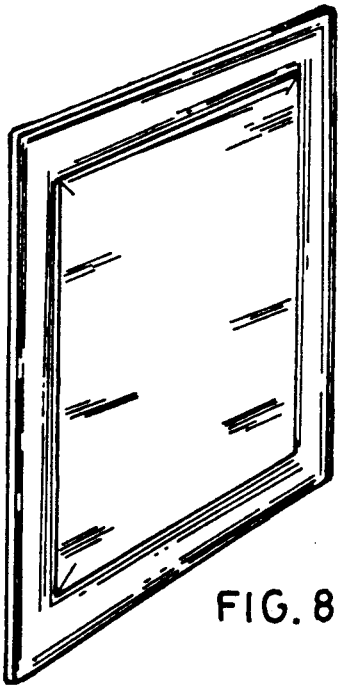
FIG. 8, is a perspective view of FIG. 7.

The process for manufacturing the cushioned article frame of the present invention consists of the following steps: (a) applying a heat-sealable adhesive 2 on a side of a base 1 of rigid material such as cardboard, wood aglomerates or briquettes, cellulose fiber or any other similar fiber, the adhesive being applied on the zones where the sealing is to be effected (FIG. 1); (b) drying or letting the adhesive to dry; (c) placing on the face of the base 1 where the adhesive 2 was applied, a layer of foam material 3 such as polyurethane foam, polyester foam, polyether foam, etc., this foam layer 3 having esentially the same shape and size of the base 1 (FIG. 2); (d) placing over the foam material a layer of heat-sealable material 4 such as a heat sealable fabric material, vinyl material or the like, the size of the layer 4 being slightly greater than the size of the base 1 (FIG. 3); (e) placing over the layer 4 of heat-sealable material a further layer of heat-sealable material 5 but this material 5 being transparent or translucent, which layer 5 is coincident with the shape 6 and size delineated by the adhesive stripes 2 (FIG. 4); (f) dielectrically sealing the edges of the transparent or translucent layer 5 (FIG. 5); (g) placing on the bottom face of base 1 a layer 7 of heat-sealable material of a size slightly greater than the size of base 1 (FIG. 6); (h) sealing the whole assembly at the edges by means of dielectrical sealing; and (i) trimming the remaining material at the edges of the assembly so as to obtain the framed cushioned article (FIGS. 7 and 8).

The transparent or translucent plastic material placed during step (e) has the purpose of providing a cover or envelope section wherein later a picture or a photograph will be placed, the article then achieving the function of framing said picture or photograph.

The article obtained by the process above described may adopt various shapes in accordance to the function it will have. It can just adopt the form of a picture frame of rectangular, square, or oval shape, etc. It can also be completed with further sections in order to provide a folder, a notebook, a photo album, etc. The article of this invention may be combined with further sections without limitation of shape and size.

The article 8 of the invention esentially consists of: a base 1 of rigid material which is resistant to sealing compression, such as cardboard, wood aglomerates, cellulose fiber and any other fibers; a section or sections 2 of a heat-sealable adhesive located on at least one of the faces of the base 1, the adhesive might be a water based adhesive or other solvent based adhesive; a foam material 3 laying over the face of base 1 provided with adhesive; layers 4 and 7 of heat-sealable material at the top and bottom of this assembly, the heat-sealable material being detectable, vinyl films, fabric bonded or laminated with a plastic material, etc.; and finally a layer 5 of a transparent or translucent heat-sealable material laying over the top layer 4 and located exactly in and in coincidence with the adhesive sections 2. The surface of the article having depressed sections formed with internal seals which delineate a frame of the desired shape and size.

Figure 9:
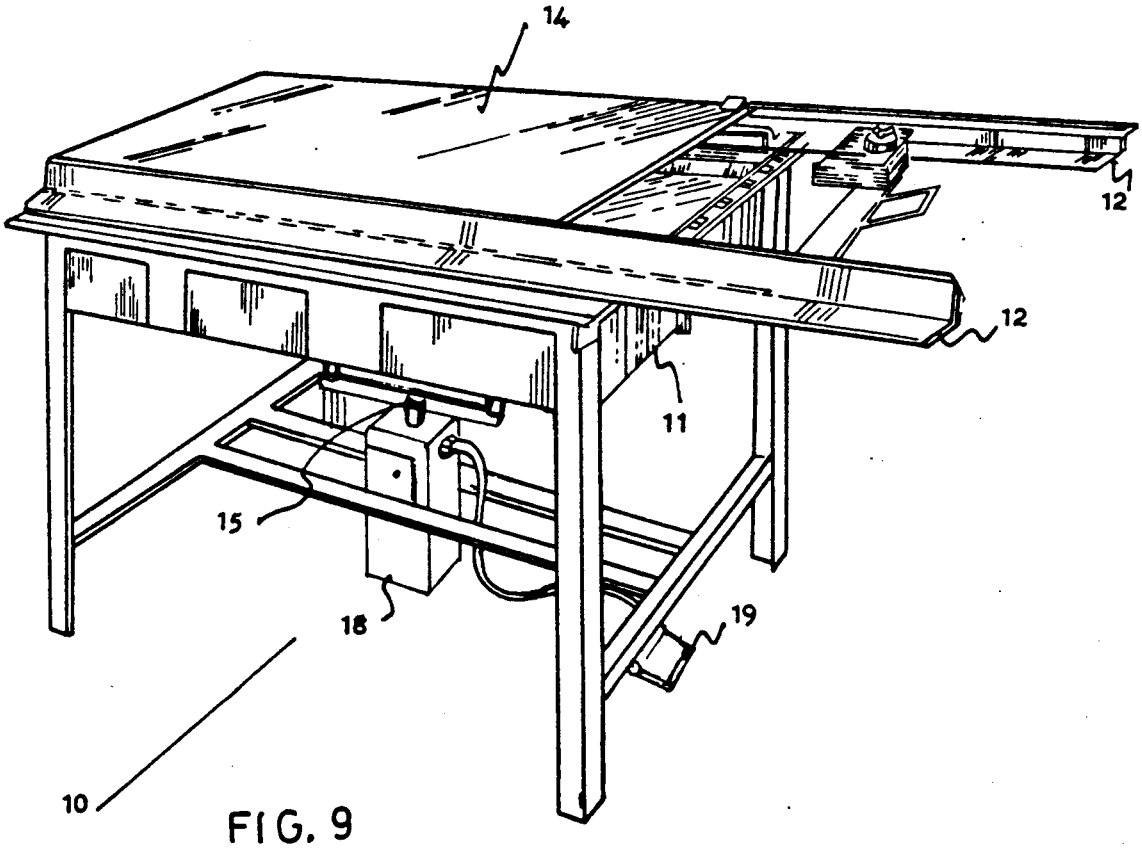
FIG. 9, is a perspective view of the gumming machine of the present invention.

The apparatus for carrying out the process of the invention (FIGS. 9 and 10) comprises an adhesive applicator or gumming machine 10 which includes a vat 11 for containing the adhesive 2, the vat 11 having a pair of guide means 12 at the upper edges of the same for guiding a frame 13 wherein the bases 1 to be gummed will be placed; a cover 14 for covering the vat 11 and avoiding over flowing of the adhesive during the gumming operation; a pair of movable and articulated arms 15, located above the vat, the arms 15 entering into vat 11 and holding therein a removable and inter-changeable adhesive printing assembly or unity 16 which includes a seal or a plurality of seals or imprinting elements 17 of desired shape and size (FIGS. 9 and 10).

The arms 15 are connected by their bottom end to a pneumatic actuator 18 with an actuating lever 19.

The gumming machine 10 is operated by: (a) placing a plurality of bases 1 in the frame 13 and introducing them over the vat 11 by means of the guiding means 12 and above the cover 14; (b) actioning the lever 19 for operating the air piston 18 which at the time raises the arms 15 along with the printing unity 16 until the seals 17 make contact with the bases 1; (c) the frame 13 is withdrawn from the vat 11 and the so gummed bases are removed and let dry.

Once the adhesive is dry, the foam material 3 and the layer 4 of heat-sealable material are placed in overlying relationship; afterwards they are placed in a locating devices 20 (FIG. 11) for adequately placing the transparent or translucent material 5 by means of an arrangement of guide plates 21 which are adjustable and movable, and are joined together by hinges 22; in open position the guide plates admit the assembly in process and in closed position the guide plates imprison the assembly and provides the exact location where the transparent or translucide material 5 should be placed. This means that the edges of said material 5 should be coincident with the delinations marked with adhesive sections in the base. When the transparent or translucent material 5 is already located in the exact site, the guide plates are opened and the assembly is released to continue the process.

Then the assembly is sealed at the delineations marked with adhesive sections, by means of a dielectrical sealer which has a pattern or electrode with the desired shape and size. At this stage the bottom layer 7 is provided and the edges of the article are dielectrically sealed. Finally the remaining material is trimmed by means of a die cutter and the finished article is obtained.

Although there has been herein described a preferred modality of the invention, it is understood that variations thereof can be effected, and by means of the following claims such variations or modifications will be covered within the spirit and scope of the invention.

The inventor claims:

1. A cushioned frame for a generally planar article, comprising:

a bottom layer of heat-sealable material having edges, a relatively rigid base of material having first and second sides, said first side having heat sealable adhesive stripes thereon defining a section to be framed, a layer of foam material secured to said base by the adhesive stripes and having substantially the configuration and size of the base, an upper layer of heat-sealable material sealed along its edge portions to edge portions of the bottom layer of heat-sealable material to enclose the layer of foam material between the upper and lower layers of heat-sealable material, and a layer of transparent or translucent heat-sealable material sized and configurated to fit in the section defined by said adhesive stripes, and disposed over the upper layer of heat-sealable material, secured thereto by depressed heat-seal stripes and cooperating with the upper layer to define an envelope to receive said picture, the layer of foam material being compressed at the heat-seal stripes which bond together the sheet of transparent or translucent material, the upper layer of heat-sealable material and the layer of foam material, thereby defining a raised bas-relief framing portion outwardly of the depressed seal stripes and a framed cushioned section.

2. An article according to claim 1, wherein:

at least the upper layer of heat-sealable material is colored.

3. An article according to claim 1, wherein:

said upper and bottom layers are of similar heat-sealable material.

4. An article according to claim 1, wherein:

said upper and bottom layers are of different respective heat-sealable materials.

5. An article according to claim 1, wherein:

said bottom layer is of a vinyl material, and said upper layer is a fabric laminated to said vinyl material and said transparent or translucent layer is of transparent vinyl plastic material.

* * * * *